US008977177B2

(12) United States Patent
Matsusaka et al.

(10) Patent No.: US 8,977,177 B2
(45) **Date of Patent: *Mar. 10, 2015**

(54) FIXING DEVICE EMPLOYING ELECTROMAGNETIC INDUCTION HEATING SYSTEM CAPABLE OF EFFECTIVELY USING MAGNETIC FLUX AND IMAGE FORMING APPARATUS WITH FIXING DEVICE

(75) Inventors: Susumu Matsusaka, Kanagawa (JP); Motokazu Hasegawa, Kanagawa (JP); Yukari Isoe, Kanagawa (JP); Tsuyoshi Hashiyada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 286 days.

This patent is subject to a terminal disclaimer.

(21) Appl. No.: 13/414,164

(22) Filed: Mar. 7, 2012

(65) Prior Publication Data

US 2012/0230743 A1 Sep. 13, 2012

(30) Foreign Application Priority Data

Mar. 9, 2011 (JP) ..... 2011-051293
Sep. 13, 2011 (JP) ..... 2011-199253

(51) Int. Cl.
*G03G 15/20* (2006.01)

(52) U.S. Cl.
CPC ..... *G03G 15/2053* (2013.01)
USPC ..... 399/329

(58) Field of Classification Search
CPC ..... G03G 15/2053
USPC ..... 399/328, 329
See application file for complete search history.

(56) References Cited

U.S. PATENT DOCUMENTS 7,196,286 B2 3/2007 Kishi et al.
7,209,675 B2 4/2007 Matsusaka et al.
7,239,821 B2 7/2007 Matsusaka et al.

(Continued)

FOREIGN PATENT DOCUMENTS

CN 101546166 A 9/2009
CN 101546167 A 9/2009

(Continued)

OTHER PUBLICATIONS

U.S. Appl. No. 13/305,015, filed Nov. 28, 2011, Hasegawa, et al.

(Continued)

*Primary Examiner* — David Gray
*Assistant Examiner* — Milton Gonzalez
(74) *Attorney, Agent, or Firm* — Oblon, McClelland, Maier & Neustadt, L.L.P.

(57) ABSTRACT

A fixing device comprises a fixing member having a heat generation layer, an excitation coil disposed opposite an outer circumferential surface of the fixing member to cause the fixing member to induce electromagnetic heat, and a magnetic core to form a continuous magnetic path guiding a magnetic flux generated by the excitation coil to the fixing member. A holder is provided to accommodate and hold the excitation coil and the magnetic core. A first core included in the magnetic core and is arranged opposite the outer circumferential surface of the fixing member not via the excitation coil along a line extended from an axis of the fixing member in a radius direction. An end face of the first core arranged opposite the outer circumferential surface of the fixing member is substantially perpendicular to the line.

19 Claims, 9 Drawing Sheets

(56) References Cited

U.S. PATENT DOCUMENTS

| | | | | |
|---|---|---|---|---|
| 7,308,216 | B2 | 12/2007 | Kishi et al. | |
| 7,313,341 | B2 | 12/2007 | Matsusaka | |
| 7,333,743 | B2 | 2/2008 | Kishi et al. | |
| 7,343,113 | B2 | 3/2008 | Matsusaka et al. | |
| 7,356,270 | B2 | 4/2008 | Matsusaka et al. | |
| 7,366,432 | B2 | 4/2008 | Kishi et al. | |
| 7,390,995 | B2 | 6/2008 | Hasegawa et al. | |
| 7,415,235 | B2 | 8/2008 | Aze et al. | |
| 7,421,224 | B2 | 9/2008 | Kishi et al. | |
| 7,447,475 | B2 | 11/2008 | Ishibe et al. | |
| 7,480,478 | B2 | 1/2009 | Aze et al. | |
| 7,496,309 | B2 | 2/2009 | Matsusaka et al. | |
| 7,515,845 | B2 | 4/2009 | Kishi et al. | |
| 7,551,869 | B2 | 6/2009 | Kishi et al. | |
| 7,565,087 | B2 | 7/2009 | Matsusaka et al. | |
| 7,603,049 | B2 | 10/2009 | Kishi et al. | |
| 7,609,988 | B2 | 10/2009 | Kishi et al. | |
| 7,664,410 | B2 | 2/2010 | Takagi | |
| 7,664,450 | B2 | 2/2010 | Aze et al. | |
| 7,835,680 | B2 * | 11/2010 | Nanjo et al. | 399/329 |
| 7,885,569 | B2 | 2/2011 | Kishi et al. | |
| 7,957,663 | B2 | 6/2011 | Kishi et al. | |
| 8,693,934 | B2 * | 4/2014 | Hasegawa et al. | 399/329 |
| 2006/0051111 | A1 | 3/2006 | Kishi et al. | |
| 2009/0245897 | A1 * | 10/2009 | Seo et al. | 399/328 |
| 2009/0245898 | A1 * | 10/2009 | Gon et al. | 399/328 |
| 2009/0317155 | A1 * | 12/2009 | Murakami et al. | 399/329 |
| 2011/0176819 | A1 | 7/2011 | Ide et al. | |

FOREIGN PATENT DOCUMENTS

| | | | | |
|---|---|---|---|---|
| CN | 101609290 | A | | 12/2009 |
| JP | 5-55669 | | | 3/1993 |
| JP | 2000-56603 | | | 2/2000 |
| JP | 2000187406 | A | * | 7/2000 |
| JP | 2002270356 | A | * | 9/2002 |
| JP | 2005-242385 | | | 9/2005 |
| JP | 2006-145780 | | | 6/2006 |
| JP | 2006-350054 | | | 12/2006 |
| JP | 2007-140086 | | | 6/2007 |
| JP | 2009-237401 | | | 10/2009 |
| JP | 2009-271156 | A | | 11/2009 |
| JP | 2010-145958 | | | 7/2010 |
| JP | 2010-204265 | | | 9/2010 |

OTHER PUBLICATIONS

U.S. Appl. No. 13/339,835, filed Dec. 29, 2011, Hashiyada, et al.

Combined Chinese Office Action and Search Report issued Mar. 28, 2014 in Patent Application No. 201210052014.9 (with English translation of categories of cited documents).

* cited by examiner

FIXING DEVICE EMPLOYING ELECTROMAGNETIC INDUCTION HEATING SYSTEM CAPABLE OF EFFECTIVELY USING MAGNETIC FLUX AND IMAGE FORMING APPARATUS WITH FIXING DEVICE

CROSS-REFERENCE TO RELATED APPLICATIONS

This patent application is based on and claims priority pursuant to 35 U.S.C. §119 to Japanese Patent Application Nos. 2011-051293 and 2011-199253, filed on Mar. 9 and Sep. 13, 2011, respectively, in the Japanese Patent Office, the entire disclosures of which are hereby incorporated by reference herein.

BACKGROUND OF THE INVENTION

1. Field of the Invention

This invention relates to a fixing device and an image formation apparatus, such as a copier, a printer, a facsimile, or a multifunctional apparatus having several of these capabilities, etc., with the fixing device capable of fixing an unfixed toner image using electrophotography.

2. Description of the Related Art

A fixing device employing an electromagnetic induction heating system is widely known, which reduces a startup time period needed in an imaging formation apparatus, such as a copier, a printer, etc., to save energy. For example, a fixing device of the Japanese Patent Application No. 2006-350054 (JP-2006-350054-A) employs an electromagnetic induction heating system and mainly consists of a supporting roller (e.g. a heating roller) as a heater, an auxiliary fixing roller (e.g. a fixing roller), a fixing belt stretched by the supporting roller and the auxiliary fixing roller therearound, an induction heating unit (e.g. an induction heating device) opposed to the supporting roller via the fixing belt, and a pressing roller contacting the auxiliary fixing roller via the fixing belt, etc. The induction heating unit mainly consists of a coil unit (e.g., an excitation coil) wound in a longitudinal direction and a core (e.g., an excitation coil core) opposed to the coil unit.

The fixing belt is heated at a position opposite an induction heating unit and heats and fixes a toner image on a recording medium conveyed to a position between the auxiliary fixing roller and the pressing roller. Specifically, by supplying an alternating high-frequency current to a coil unit and thereby forming an alternating magnetic field therearound, an eddy current is generated near a surface of the supporting roller. When the eddy current is generated, the supporting roller generates Joule heat by its own electrical resistance as a heater. Due to the Joule heat, the fixing belt wound around the supporting roller is heated. Since the heater is directly activated by the electromagnetic induction, it is known that the fixing device with an electromagnetic induction heating system like this has a higher thermal effectiveness and is capable of increasing a surface temperature (i.e., a fixing temperature) of a fixing belt to a prescribed level achieving quick startup with less energy than a conventional system with a halogen heater or the like.

A coil unit used in the induction heating system mainly consists of an excitation coil and a core for guiding an alternating magnetic field arising from the excitation coil. FIG. 22 shows a cross-sectional view of a fixing device using a conventional technology described in JP-2006-350054-A. As shown there, from a coil 25 to a long supporting roller 23 that doubles as a roller type heater, multiple arch-type cores 26 are placed in a lengthwise direction thereof covering the coil in a dome shape, thereby forming a continuous magnetic circuit. Further, since a magnetic channel to the heater is insufficient if formed only by the arch-type cores 26, a side core 26*b* and/or a center core 26*a* are additionally employed to reduce leakage of an alternating magnetic flux to improve heat generation effectiveness.

Further, in the fixing device described above, a pair of side cores 26*b* is arranged parallel to each other or parallel to a secondary hold unit 20 that functions as a part of a housing of the fixing device 19. However, the side core 26*b* is not extended along a radial line drawn from an axis of the supporting roller 23 in a radius direction. In addition, an end face of the side core 26*b* placed opposite an outer circumferential surface of the supporting roller 23 is not perpendicular to the radial line. Accordingly, leakage of magnetic flux occurs, and accordingly heat generation effectiveness deteriorates due to the presence of a magnetic flux not passing through the supporting roller.

As described later in detail with reference to FIG. 8, it has been found through experiment that the heat generation effectiveness of the induction heating system can be upgraded if the core is placed to increase an area of the core opposite the supporting roller of the heater and reduce the leakage of the magnetic flux not passing through the supporting roller.

Japanese Patent Application Publication No. 2000-056603 (JP-2000-056603-A) discloses a technology in which an opposed surface of a ferromagnetic core opposite a fixing roller as a heater is molded to a prescribed shape almost parallel to a fixing roller to increase an area of the opposed surface thereof. A magnetic flux caused by an excitation coil concentrates within a space between leading ends of protruding portions of the ferromagnetic core, so that leakage of the magnetic field outside of a magnetic circuit, which mainly consists of the ferromagnetic core and a conductive layer on a fixing roller, is decreased. However, forming the opposed surface opposite the magnetic core made of ferrite in parallel to the fixing roller is generally difficult and costly. For molding the ferrite core itself, a method of baking and hardening ferrite powder in a mold is usually employed. However, a problem caused by this manufacturing method is that the core shrinks during a sintering process, and accordingly its dimensional accuracy is degraded.

In addition, highly accurate dimensioning is needed for locating a surface of the core opposite the fixing roller due to the shape of the fixing roller, and as a result, the fixing unit cannot be assembled when the dimensional accuracy is poor. To avoid this problem, the surface of the core opposite the fixing roller must undergo additional processing, such as cutting, etc., thereby increasing manufacturing cost.

BRIEF SUMMARY OF THE INVENTION

Accordingly, the present invention provides a novel fixing device comprising a fixing member having a heat generation layer, an excitation coil disposed opposite an outer circumferential surface of the fixing member to cause the fixing member to induce electromagnetic heat, and a magnetic core to form a continuous magnetic path guiding a magnetic flux generated by the excitation coil to the fixing member. A holder is provided to accommodate and hold the excitation coil and the magnetic core. A first core is included in the magnetic core and is arranged opposite the outer circumferential surface of the fixing member not via the excitation coil along a line extended from an axis of the fixing member in a radius direction. An end face of the first core arranged opposite the outer circumferential surface of the fixing member is substantially perpendicular to the line.

In another aspect, a second core having a curved end face at its one end is provided to contact the first core. The magnetic core covers most of the above-mentioned excitation coil.

In yet another aspect, the first core has a substantially rectangular parallelepiped shape.

In yet another aspect, a pair of first cores contacts the second core and is not arranged parallel to each other in the holder.

In yet another aspect, a spacer is provided between the holder and the first core to position the first core.

In yet another aspect, the spacer is constituted by a rib integrally molded with the holder.

In yet another aspect, the fixing device is a belt type and includes a heating roller as the fixing member, an auxiliary fixing roller, a fixing belt stretched by the heating roller and the auxiliary fixing roller, and a pressing roller pressing against the auxiliary fixing roller through the fixing belt.

In yet another aspect, the fixing member is a roller type and includes a heating roller as the fixing member, and a pressing roller pressing against the fixing roller.

In yet another aspect, an image forming apparatus forming an image comprises an image formation device to form a toner image and a fixing system to fix the toner image. The fixing system includes a fixing member having a heat generation layer, an excitation coil disposed opposite an outer circumferential surface of the fixing member to cause the fixing member to induce electromagnetic heat, and a magnetic core to form a continuous magnetic path guiding a magnetic flux generated by the excitation coil to the fixing member. The fixing system also includes a holder to accommodate and hold the excitation coil and the magnetic core and a first core included in the magnetic core. The first core is arranged opposite the outer circumferential surface of the fixing member not via the excitation coil along a line extended from an axis of the fixing member in a radius direction. An end face of the first core arranged opposite the outer circumferential surface of the fixing member is substantially perpendicular to the line.

BRIEF DESCRIPTION OF THE DRAWINGS

A more complete appreciation of the present invention and many of the attendant advantages thereof will be more readily obtained as the same becomes better understood by reference to the following detailed description when considered in connection with the accompanying drawings, wherein.

DETAILED DESCRIPTION OF THE INVENTION

Figure 1:
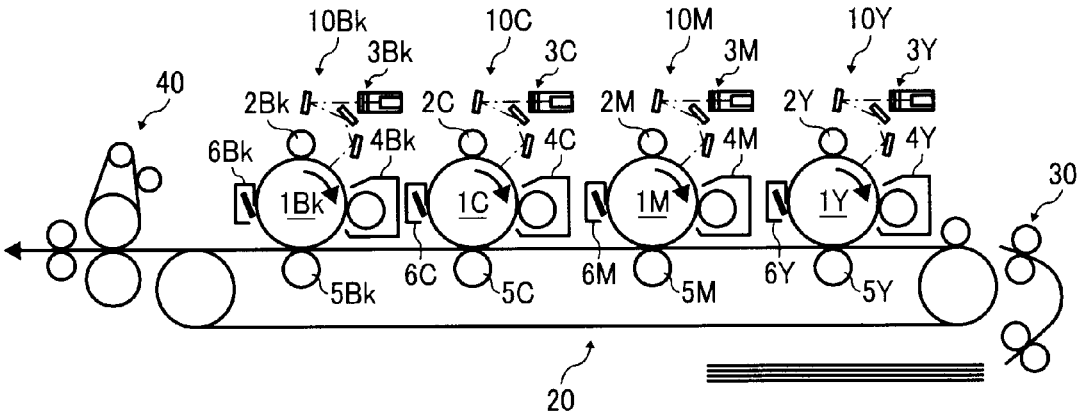
FIG. 1 is a schematic block diagram illustrating the entire configuration of an image forming apparatus.

Referring now to the drawings, wherein like reference numerals designate identical or corresponding parts throughout the several views thereof and in particular to FIG. 1, a configuration and an operation of an image forming apparatus are entirely described. This printer includes four image formation units 10Y, 10M, 10C, and 10Bk employing electrophotographic systems to form yellow, cyan, magenta, and black toner images on surfaces of image bearers 1Y, 1M, 1C, and 1Bk as photoreceptor drums, respectively. Below image formation units 10Y, 10M, 10C, and 10Bk, there is provided a conveyor belt 20 for transporting a paper sheet (i.e., a recording member) through each of the image formation units.

Each photoconductor drum, 1Y, 1M, 1C, or 1Bk of the image formation unit 10Y, 10M, 10C, or 10Bk contacts a surface of the conveyor belt 20. A paper sheet is electrostatically attracted to a surface of the conveyor belt 20. These four image formation units 10M, 10Y, 10C, and 10Bk have substantially the identical structure with each other. Therefore, the image formation unit 10Y arranged upstream most in a sheet transport orientation is typically explained hereinafter, and specific descriptions of the remaining image formation units 10M, 10C, and 10Bk are omitted while the same signs are added to corresponding devices.

The image formation unit 10Y includes a photoreceptor drum 1Y rotated contacting the conveyor belt 20 at its almost central position. Around the photoconductor drum 1Y, there are provided a charge device 2Y for charging a surface of the photoconductor drum 1Y with a certain potential, an exposure device 3Y to execute exposure based on an image signal obtained by color separation onto a surface of a drum previously charged, a developing device 4Y for supplying yellow toner to an electrostatic latent image formed on a surface of the drum to develop the electrostatic latent image, a transfer roller 5Y as a transfer device to transfer the developed toner image onto a paper sheet conveyed via the conveyor belt 20, a cleaner 6Y to remove residual toner remaining on the drum surface not transferred therefrom, and a charge removing lamp, not shown, to remove an electrical charge remaining on the photoconductor drum 1Y in this order in a rotation direction thereof.

On the right-lower side of the conveyor belt 20 in the drawing, a paper sheet feeding mechanism 30 is provided to feed a paper sheet onto a conveyor belt 20. On the left side of the conveyor belt 20 in the drawing, a fixing device 40 of the present invention described later is disposed. The paper sheet transported by the conveyor belt 20 is further transported onto a conveyance path continuously extended from the conveyor belt 20 through the fixing device 40 and passes through the fixing device 40.

The fixing device 40 applies heat and pressure onto the thus conveyed paper sheet bearing the toner image of each color on its surface. The fixing device 40 then fuses the toner image of the each color so that the toner image penetrates the paper sheet and is fixed. The paper sheet is then ejected downstream of the fixing device 40 on the conveyance path.

Now, the fixing device 40 according to one embodiment of the present invention is described with reference to FIG. 2. This fixing device 40 employs a belt fixing system and includes a heating roller (i.e., a support roller) 51 as a fixing member equipped with a heat generation layer, an auxiliary fixing roller 52, a fixing belt 53 stretched by the heating roller 51 and the auxiliary fixing roller 52, an induction heating coil 54 opposed to the heating roller 51 via the fixing belt 53, and a pressing roller 55 contacting the auxiliary fixing roller 52 via the fixing belt 53.

The heating roller 51 can be made of metal, such as stainless steel, aluminum, iron, etc., to have a prescribed thickness and a stiffness (rigidity) to withstand a load imposed when the fixing belt 53 is stretched. Further, a metal core layer can be made of material having insulating and non-magnetic properties, such as ceramic, etc., to be isolated from the electromagnetic induction heating. The thickness of the metal core layer is preferably from about 0.2 mm to about 1 mm.

In this first embodiment, the heating roller 51 is made of non-magnetic stainless steel (SUS) and includes a metal core layer having a thickness of from approx. 0.2 mm to approx. 1 mm. A heat generation layer made of copper (Cu) having a thickness of about 3 μm to about 15 μm is formed on a surface of the metal core to increase heat generation effectiveness. In this situation, nickel plating may be preferably applied to the Cu surface layer for the purpose of rust prevention.

Magnetic shunt alloy having a curie point of from about 160 degree Celsius to about 220 degree Celsius can be used instead of the stainless steel as another example. In this situation, the magnetic shunt alloy can be used as a heat generation layer. Copper having a thickness of from about 3 μm to about 15 μm may be formed on the magnetic shunt alloy as a heat generation layer. By disposing aluminum in the interior of the magnetic shunt alloy, temperature can be stopped increasing near the curie point without a particular control mechanism.

The auxiliary fixing roller 52 is constituted by a metal core 52*a* made of stainless steel, carbon steel, etc., and an elastic member 52*b* made of silicone rubber or the like with heat resistance wrapped around the metal core 52*a* in a solid or foam state. The auxiliary fixing roller 52 thus forms a contact (i.e., a fixing nip section N) having a prescribed width between the pressing roller 55 and the auxiliary fixing roller 52 under pressure applied from the pressing roller 55. The auxiliary fixing roller 52 preferably has an outer diameter of from approx. 30 mm to approx. 40 mm, a thickness of from approx. 3 mm to approx. 10 mm, and a hardness of from about 10 degree to about 50 degree (JIS-A).

Figure 3:
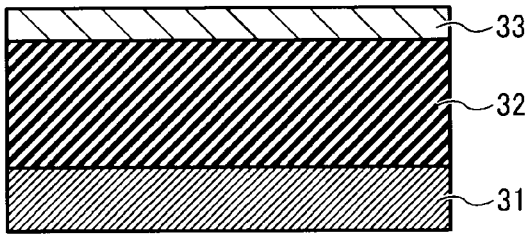
FIG. 3 is a cross-sectional view illustrating one example of a fixing belt.

Now, one example of a fixing belt 53 is described in greater detail with reference to FIG. 3 showing a cross-sectional view thereof. As shown, the fixing belt 53 mainly consists of a substrate 31, an elastic layer 32 stacked on this substrate 31, and a mold-releasing layer 33 overlying this elastic layer 32. Thus, a prescribed mechanical strength and flexibility required for the base 31 when a belt is stretched and a heat-resistance capable of withstanding a fixing temperature practically used can be obtained. To cause heat induction in the heating roller 51 in this embodiment of the present invention, insulating heat-resistant resin material is preferably used as the substrate 31. For example, one of polyimide, polyimide-amide, polyether-ether ketone (PEEK), polyether sulfide (PES), polyphenylene sulfide (PPS), and fluoropolymer or the like is suitable for a heat-resistant plastic material. A thickness of the heat-resistant plastic material desirably ranges from about 30 μm to about 200 μm from a view point of heat and strength.

The elastic layer 32 is employed to give flexibility to a belt surface and thereby obtaining a uniform image without uneven glossiness. The elastic layer 32 is thus desirably made of elastomer material with a hardness of from about 5 degree to about 50 degree (JIS-A) and a thickness of from about 50 μm to about 500 μm. Further, silicone and fluorosilicone rubbers or the like are preferably used as material of the elastic layer 32 from a view point of heat-resistance under a fixing temperature.

As the material of the mold releasing layer 33, fluorine resin, such as tetrafluoride ethylene resin (PTFE), tetrafluoride ethylene-Perfluoroalkyl vinylether copolymer resin (PFA), and tetrafluoride ethylene-hexafluoride propylene copolymer (FEP), etc., or these resin mixture, or heat-resistant resin with these dispersions is exemplified.

By coating the mold releasing layer 33 with the elastic layer 32, prescribed releasing performance of toner can be obtained preventing paper dust sticking without using silicone oil, thereby realizing an oil-less system. However, these resins with the mold releasing performance do not have elasticity like rubber material in general. Thus, when a thick mold releasing layer 33 is formed on the elastic layer 32, flexibility of the belt surface is lost by some degree causing uneven glossiness. To obtain both the flexibility and the mold releasing performance, a thickness of the mold releasing layer 33 preferably ranges from about 5 μm to about 50 μm, and more desirably from about 10 μm to about 30 μm. Further, a primer layer may be preferably placed between each of the layers as needed.

A durable layer is also disposed on an inner surface of the substrate to improve durability under a sliding condition. Further, a heat generation layer may be preferably disposed on the substrate 31. For example, a cu-layer having a thickness of from about 3 μm to about 15 μm is formed on a base layer made of polyimide, etc., to be used as a heat generation layer.

The pressing roller 55 mainly consists of a cylindrical metal core 55*a*, a high heat-resistant elastic layer 55*b*, and a mold releasing layer 55*c*, and form a fixing nip N by pressing against the auxiliary fixing roller 52 through the fixing belt 53. An outer diameter of the pressing roller 55 is from approx. 30 mm to approx. 40 mm. A thickness of the elastic layer is from approx. 0.3 mm to approx. 5 mm having a hardness of from about 20 degree to about 50 degree (Asker hardness). Since a prescribed heat resistance is needed, silicone rubber is preferably used as an elastic layer 55*b*. Further, a mold releasing layer 55*c* made of fluorine resin with a thickness of from about 10 μm to about 100 μm is formed on the elastic layer 55*b* to further increase the mold releasing performance for a two-sided printing operation.

With a harder elastic layer 55*b* of the pressing roller 55 than that of the auxiliary fixing roller 52, the pressing roller 55 digs into the auxiliary fixing roller 52 and the fixing belt 53. With this digging, the fixing belt 53 has a curvature impossible for a recording medium to go along the surface thereof at an exit of the fixing nip N. Thus, a releasing performance of a recording medium releasing from a pressing roller 55 can be improved thereby capable of preventing a problem, such as sheet jam, etc., beforehand.

Figure 4A:
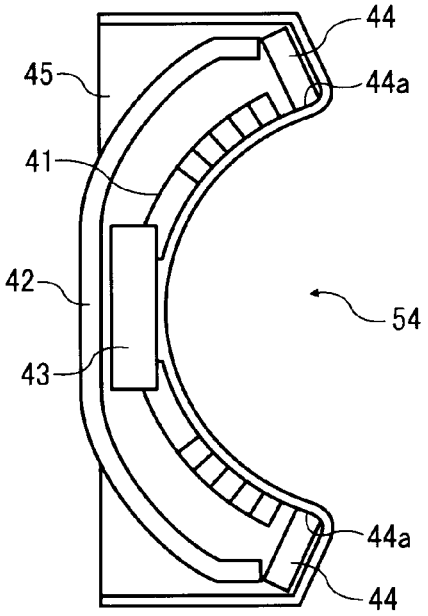
FIG. 4A is a cross-sectional view schematically showing a configuration of an induction heating coil included in the fixing device.
Figure 4B:
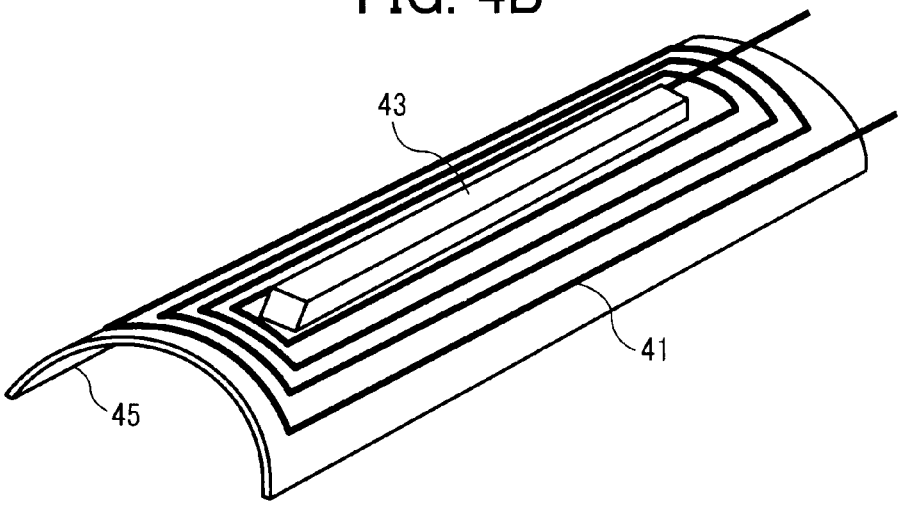
FIG. 4B is a perspective view schematically showing a configuration of an excitation coil.

Now, an induction heating coil 54 formed in a coil unit is described with reference to FIGS. 4A and 4B. FIG. 4A is a cross-sectional view of an induction heating coil 54 included in a fixing device 40 according to one embodiment of the present invention. The induction heating coil 54 mainly consists of an excitation coil 41, multiple ferromagnetic cores 42, 43, and 44, and a casing 45 as a holder holding those.

Now, a magnetic core is described in greater detail. The ferromagnetic core almost encircles an excitation coil 41 and mainly consists of an arch core 42 as a second core located at a position behind the excitation coil 41 and opposite an outer surface of the heating roller 51, a side core 44 as a first core disposed opposite the outer surface of the heating roller 51 not via the excitation coil 41 nearer the heating roller 51 than the arch core 42, and a center core 43. The ferromagnetic core forms a continuous magnetic path to concentrate a magnetic flux arising from the excitation coil 41 on the heating roller 51. The side core 44 is placed on a side of the casing 45. The center core 43 is placed at a center of the casing 45. The arch core 42 engages the side core 44.

Figure 2:
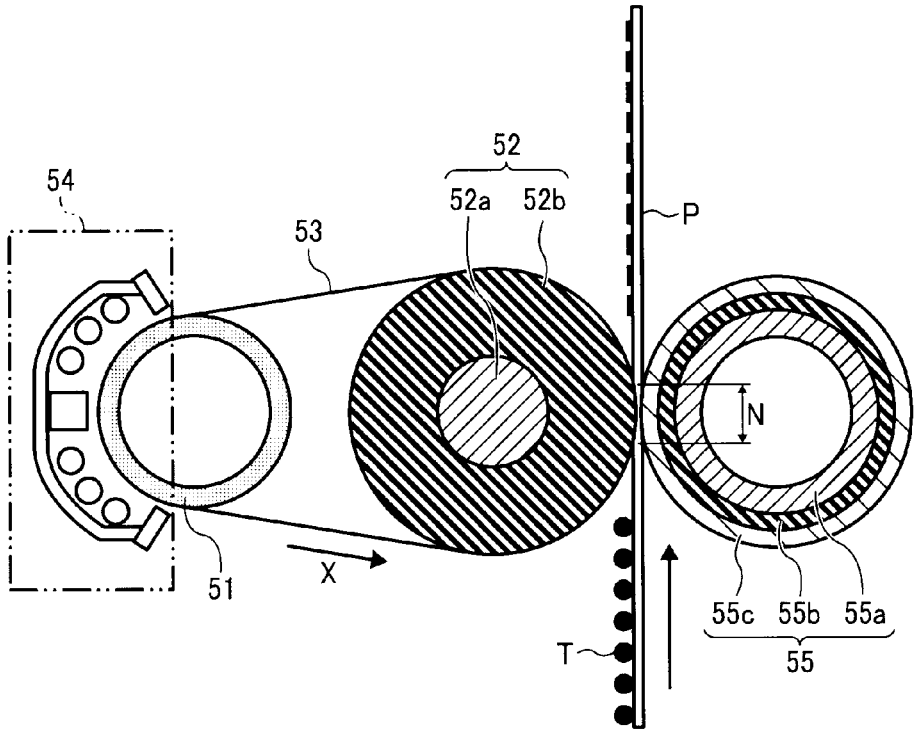
FIG. 2 is a schematic cross-sectional view of a configuration of a fixing device.

The arch core 42 has multiple pieces disposed in a longitudinal direction of the heating roller 51 (i.e., front and rear sides in FIG. 2 at prescribed intervals so that temperature distribution of the heating roller 51 becomes uniform in the longitudinal direction thereof. The ferromagnetic core is desirably made of soft magnetic material having less coercive force and large permeability with a high electrical resistance, such as ferrite, permalloy, Mn—Zn ferrite, Ni—Zn ferrite, etc.

Since the ferrite core is molded and sintered using ferrite powder under compression, a problem, such as ferrite core shrinkage, etc., occurs during the sintering as mentioned above resulting in low dimensional accuracy of the ferrite core.

Then, in the first embodiment, the side core 44 and the center core 43 each has an I-letter shape (i.e., a rectangular parallelepiped core) to substantially equally receive pressure when powder is molded under compression and ensure prescribed dimensional accuracy thereof. As shown in FIG. 4A, the side core 44 and the center core 43 are extended between front and rear sides in the drawing as slender rectangular parallelepiped cores. As described later with reference to FIG. 8, to increase an area of the side core 44 opposite the heating roller 51, the side core 44 is placed along a radial line extended from an axis of the heating roller 51. In addition, an end face 44*a* of the side core 44 opposed to an outer circumferential surface of the heating roller 51 is arranged almost perpendicular to this line.

Now, the excitation coil 41 is described. The excitation coil 41 is prepared by winding up litz wires from 5 times to 15 times, each of which is obtained by twisting from about 50 pieces to about 500 pieces of conductive lines each having a diameter of from approx. 0.05 mm to approx. 0.2 mm with an insulation coat. A fusion layer is provided on a surface of a litz wire, and is stiffened by applying heat either by means of supplying power or in a thermostatic oven, so that a shape of the wound coil can be maintained. Instead of this, a coil can be prepared by winding litz wires without fusion layers, but are subjected to press molding to provide the shape thereto. Since the litz wire needs a prescribed heat-resistance higher than a fixing temperature, prescribed resin, such as polyamide-imide, polyimide, etc., having insulation performance and heat resistance at the same time is used for wire insulation coat.

The excitation coil 41 thus formed is glued to the casing 45 using silicone glue or the like. Since the heat resistance higher than a fixing temperature is needed for resin of the casing 45, liquid crystal polymers or polyethylene terephthalate (PET) and the like having a high heat-resistance is used.

Now, a configuration of the excitation coil 41 of the first embodiment is described in greater detail with reference to FIG. 4B. The excitation coil 41 for heating the fixing belt 53 by means of electromagnetic heat induction is formed by circulating a wire flux obtained by bundling up 90 pieces of lines made of copper having an outer diameter of about 0.15 mm with an insulated surface thereon. The excitation coil 41 is disposed over the entire width of the surface of the casing 45 in a spiral state partially covering an outer circumferential surface of the heating roller 51 serving as a heat generation member or a fixing member. Further, a coil is wound in a prescribed shape in a rotation axis direction around the center core 43 along the circumference of the fixing belt 53.

Now, a behavior of the fixing device 40 configured as described above is described. The fixing belt 53 rotates in a direction as shown by arrow X in FIG. 2 as a driving motor, not shown, operates. The heating roller 51 is heated by means of induction heating caused by the induction heating coil 54 and heats the fixing belt 53. Specifically, high-frequency alternating current with from about 10 kHz to about 1 MHz is supplied to the induction heating coil 54, and magnetic lines are thereby generated alternating directions within a loop of the induction heating coil 54. By forming an alternating magnetic field in this way, eddy current and accordingly joule heat occur in the heating roller 51, thereby heating the heating roller 51 with the induction heating. The fixing belt 53 is then heated by heat supplied from the heating roller 51, so that a toner image T borne on a recording medium P is ultimately heated and the toner image T thereon melts when the recording medium P transported to the fixing nip N contacts the fixing belt 53.

With thus improved performance of the induction heating, temperature of the surface of the fixing belt 53 quickly increases, and startup performance may be significantly improved as well. The startup performance represents a temperature rising time required for the fixing belt 53 to fix a toner image T. Thus, the shorter the temperature rising time, the better the user friendliness when using an image formation apparatus.

Now, a first embodiment is described in detail. In the first embodiment, the side core 44 is disposed along a line extended from an axis of the heating roller 51 in a radius direction. By placing an end face 44*a* of the side core 44 opposite the outer circumferential surface of the heating roller 51 almost perpendicular to the line, an area of the side core opposite the outer circumferential surface of the heating roller 51 increases, so that leakage of flux not passing through the heating roller 51 is reduced, thereby upgrading heat generation effectiveness. Now, reasons for upgrading the heat generation effectiveness is described based on comparison between various embodiments of the present invention and conventional examples.

Figure 5:
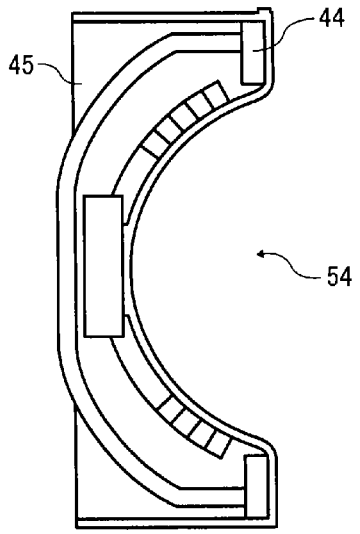
FIG. 5 (Related Art)
FIG. 5 is a diagram showing a configuration of a conventional induction heating coil in which side cores are arranged either parallel to each other or almost perpendicularly in a casing.

First, FIG. 5 indicates a conventional configuration of an induction heating coil 54 in which side cores 44 are positioned either parallel to each other or perpendicularly in the casing 45. The induction heating coil 54 is usually located opposite the heating roller 51 formed in a cylindrical shape, and accordingly, the side cores 44 are frequently placed parallel to each other in the casing 45 due to a shape of the casing 45. As a result, a surface of the side core 44 opposite the heating roller 51 is not positioned right in front of the outer circumferential surface of the heating roller 51.

Figure 6:
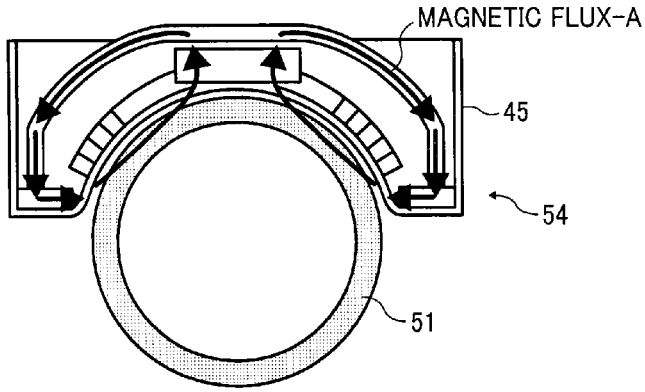
FIG. 6 (Related Art)
FIG. 6 is a schematic cross-sectional view of a conventional induction heating coil and a heating roller with a schematic aspect of a magnetic flux arising from an excitation coil.

FIG. 6 is a diagram partially showing a conventional heating roller 51 and an induction heating coil 54 as well as an aspect of magnetic flux arising from the excitation coil 41. As shown, the magnetic flux A arising from the excitation coil 41 travels a route constituted by the center core 43, the arch core 42, and the side core 44 passing through the heating roller 51 thereby heating the heat layer therein. The magnetic flux A then returns to the core. At this moment, the magnetic flux A is flown in the core made of magnet forming a core shape when passing therethrough. However, the flux A spreads in a gap between the heating roller 51 and the side core 44 where the core is absent. Further, a magnetic field arising from the leading end of side core 44 is similar to that arising from a bar type magnetic pole.

Figure 7:
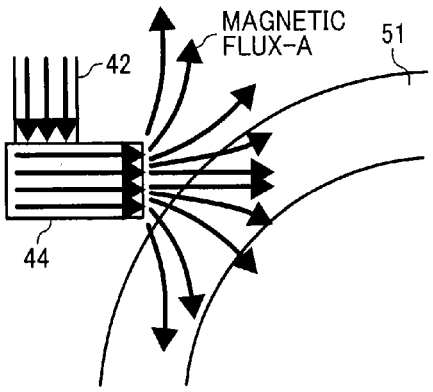
FIG. 7 (Related Art)
FIG. 7 is an aspect of a conventional magnetic flux existing in a gap between a heating roller and a side core.

FIG. 7 shows an aspect of a conventional magnetic flux A produced in the gap between the heating roller 51 and the side core 44. The magnetic lines concentrate and density of magnetic flux is high at a leading end of the side core 44. However, the magnetic flux A diffuses drawing a parabola as parting from the core in the gap. Accordingly, there is magnetic flux not passing through the heating roller 51 as a leakage among that passing through the side core 44 as illustrated, so that heat generation effectiveness is poor.

Figure 8:
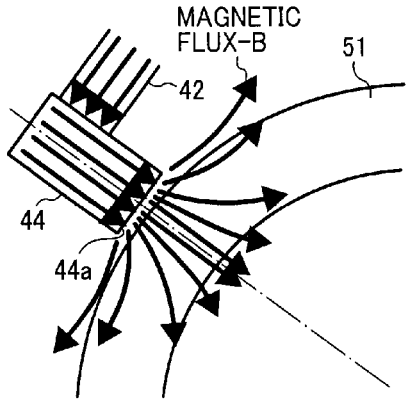
FIG. 8 is a diagram showing an aspect of the magnetic flux in the gap between heating roller and a side core according to a first embodiment of the present invention.

Whereas, FIG. 8 shows an aspect of a magnetic flux B produced at the gap between the heating roller 51 and the side core 44 according to one embodiment of the present invention. As indicated, the side core 44 is placed along a line extended from an axis of the heating roller 51 in a radius direction. In addition, an end face 44*a* of the side core 44 opposite the outer circumferential surface of the heating roller 51 is positioned almost perpendicular to this line. In other words, the side core 44 is inclined from the conventional one so that the end face 44*a* thereof opposite the heating roller 51 almost stands parallel to the outer surface of the heating roller 51.

Hence, the magnetic flux B, which is diffused while separating away from the core drawing the parabola almost passes through the heating roller 51. When the magnetic flux B passes through the heating roller 51, current is induced and flown into a metal heat generation layer constituting the heating roller 51, and the heating roller 51 thereby generates heat as Joule heat. Percentage of the magnetic flux successfully passing through the heating roller 51 to the leakage, i.e., heat generation effectiveness, is dependent on a distance of the gap between the side core 44 and the heating roller 51. Thus, when the distance between the side core 44 and the heating roller 51 in this embodiment is the same to that in a conventional system, this embodiment can allow much more magnetic flux B to pass through the heating roller 51 thereby capable of improving effectiveness of heat generation than the conventional system.

Hence, the area of the side core opposite the heating roller is easily increased by using the I-shape side core capable of obtaining prescribed dimensional accuracy, so that leakage of the magnetic flux not passing through the heating roller is reduced, thereby capable of increasing the heat generation effectiveness.

Figure 9:
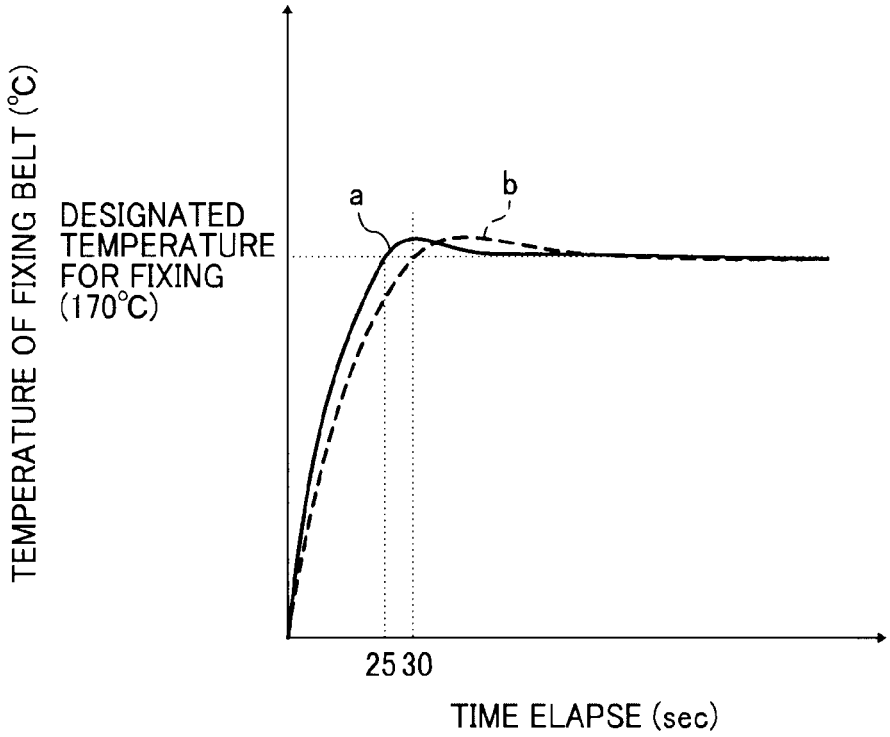
FIG. 9 is a diagram showing comparison of startup performance of a conventional fixing device with that of the first embodiment obtained through heating experiment.

Now, startup performance of the fixing device of this embodiment is described with reference to FIG. 9 by comparing it with that of a conventional system obtained through the below described heating experiment. In the experiment, a fixing device having a configuration of this embodiment as shown in FIG. 4A and a conventional fixing device having a configuration as shown in FIG. 5 are used. Specifically, only a manner of arranging the side core 44 is different and configuration is almost the same with each other.

In the experiment, a time period from a time when power is supplied to the fixing belt 53 to a time when surface temperature thereof reaches a prescribed fixing setting temperature of 170 degree Celsius is measured. As shown by a temperature curve (b), a conventional fixing device using the side core of the first example has started up in 30 seconds. Whereas the fixing device with the side core of this first embodiment has started up in 25 seconds as shown by temperature curve (a). Thus, it is found that the fixing device of this first embodiment has started up 5 seconds earlier than the conventional fixing device, while leaked magnetic flux not passing through the heating roller 51 decreases, so that heat generation effectiveness is improved. Hence, a fixing device having a preferable startup performance is realized in this first embodiment with a simple configuration.

Figure 10A:
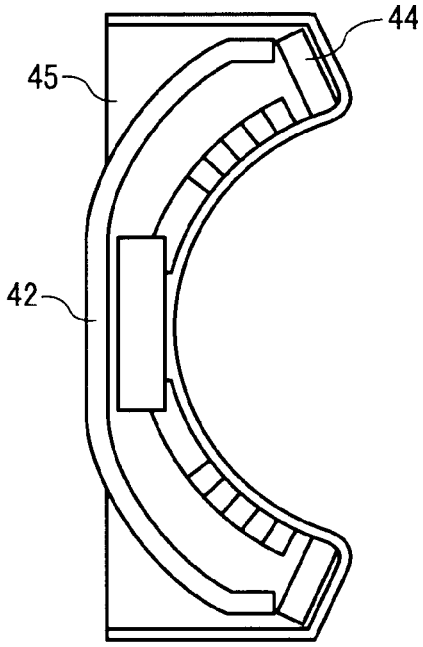
FIGS. 10A and 10B are diagrams illustrating an example, in which a side core is arranged with its leading end face opposite the heating roller being parallel to an outer circumferential surface of the heating roller.
Figure 10B:
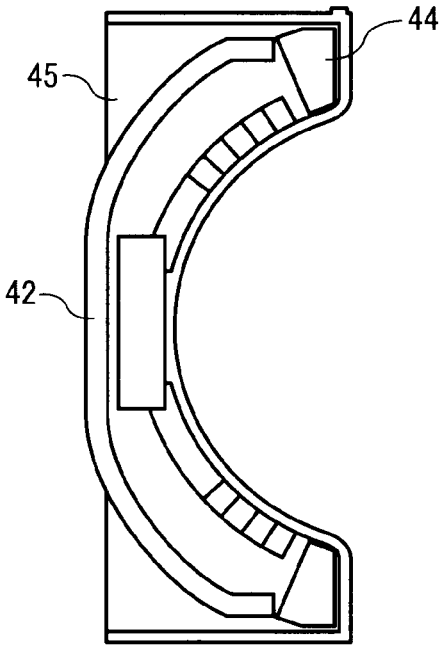
Figure 11:
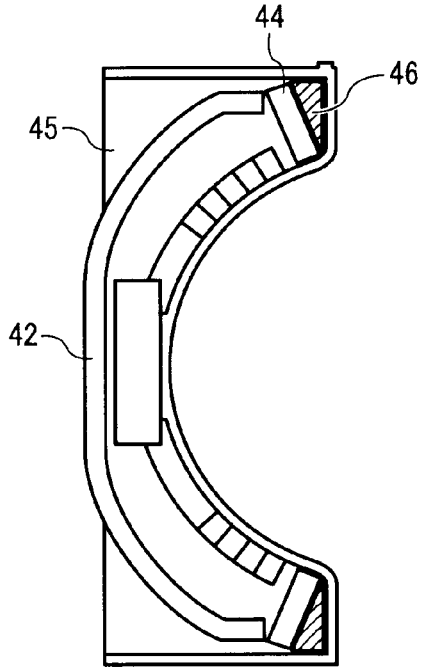
FIG. 11 is a diagram illustrating another example, in which a side core is arranged with its leading end face opposite the heating roller being parallel to an outer circumferential surface of the heating roller.
Figure 12:
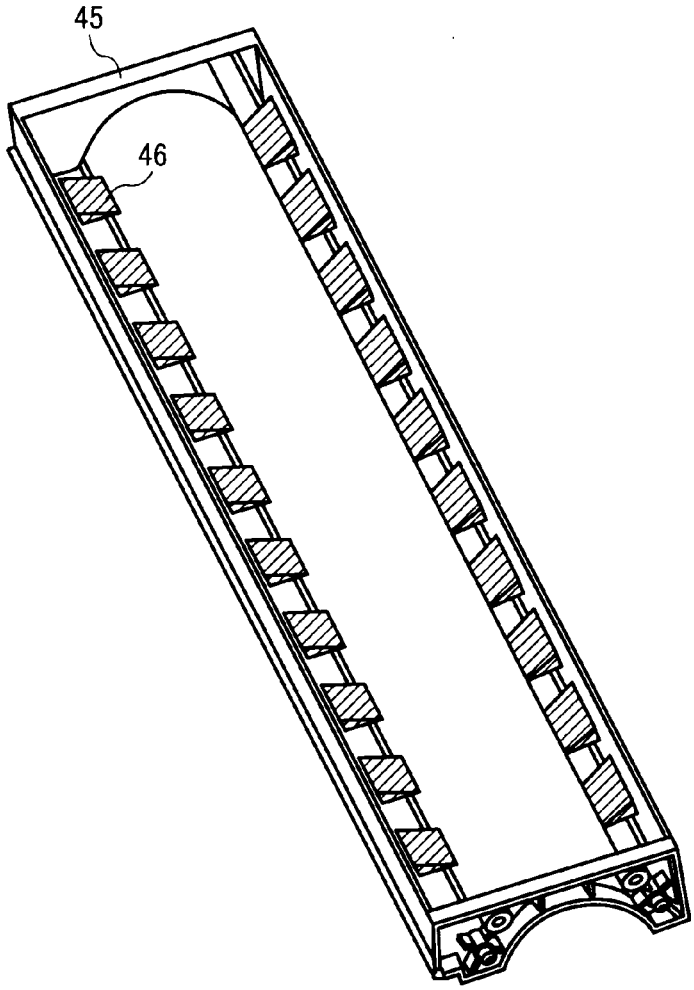
FIG. 12 is a diagram illustrating yet another example, in which a side core is arranged with its leading end face opposite the heating roller being parallel to an outer circumferential surface of the heating roller.

Now, with reference to FIGS. 10 to 12, a specific example is described, in which the side core 44 is disposed along a line extended from an axis of the heating roller 51 in a radius direction thereof, while an end face 44*a* of the side core 44 opposite the outer circumferential surface of the heating roller 51 is disposed almost perpendicular to the line. FIG. 10A shows a manner of molding a plastic casing 45 to enable the I-shaped side core 44 to be diagonally placed as also shown in FIGS. 2 and 4A. Specifically, a right end part of the casing 45 is obliquely placed, i.e., not vertically formed, and the I-shaped side core 44 is accordingly obliquely placed. The end face 44*a* of the side core 44 disposed opposite the heating roller 51 becomes almost parallel to the outer circumferential surface of the heating roller 51. Because, the I-shaped core possible to be molded with high dimensional accuracy can be used according to this method, a defective core caused by a variation in dimension is rarely produced. Further, the I-shaped core itself is a versatile member and does not need a specially design, a cost can be reduced.

Now, a modification of the side core 44 is described with reference to FIG. 10B. The side core 44 can be shaped in a polygon, such as a pentagon, a hexagon, etc., so that an end face 44*a* of the side core 44 opposite the outer circumferential surface of the heating roller 51 can be disposed almost perpendicular to the line when the side core 44 is disposed along a line extended from an axis of the heating roller 51 in a radius direction thereof. Hence, since the conventional casing 45 can be utilized, molding of the casing 45 can be easier. However, molding of this core is generally difficult in comparison with that of the I-shaped core.

Now, yet another modification of the side core 44 is described with reference to FIG. 11. As illustrated, a wedge-shaped spacer 46 is disposed between the side core 44 and the casing 45 to position the side core 44, so that a leading end face of the core can be parallel to an outer circumferential surface of this heating roller. The spacer 46 is not limited to the wedge-shape, and the other shape can be employed if it causes a leading end face of the side core 44 to be parallel to the outer circumferential surface of the heating roller when the side core 44 is disposed. Further, a length of the arch core 42 contacting the side core 44 can be appropriately adjusted.

FIG. 12 is perspective view illustrating an interior of the casing 45 with a modification of the spacer 46. However, none of the excitation coil 41, the arch core 42, the center core 43, and the side core 44 is shown here. The spacer 46 is formed as a rib 46 of the casing 45 using insert-molding. Specifically, twenty pieces of ribs 46 are formed, and twenty pieces of side cores are disposed thereon, respectively. These ribs 46 are disposed in a longitudinal direction of the casing, thereby increasing rigidity thereof. Since the casing 45 is thus strengthened by these ribs 46, a thickness of a wall of the casing 45 other than rib-molded parts can be decreased. In general, heat generation effectiveness of induction heating increases when a core and an excitation coil 41 are placed close to a heat generation layer of a heating roller 51. Thus, when the casing 45 is manufactured thinner, the core and the excitation coil 41 can be placed closer to the heat generation layer, so that the heat generation effectiveness can be increased. Hence, by disposing the leading end face 44*a* of the side core 44 in parallel to the outer surface of the heating roller 51 while thinning the casing 45 and placing the core and the excitation coil 41 closer to the heat generation layer of the heating roller 51, a rigid coil unit having high heat generation effectiveness can be obtained.

Now, a modification of the arch core 42 is described with reference to FIG. 13. As shown, a shape of the arch core is only different from that of the first embodiment while the other configuration is substantially identical therewith in this modification. Initially, a nature of the arch core is briefly described. The core contracts in a sintering process. However, since both ends of the arch core is opened or a level of shrinkage is different between an opening portion and a communicating portion thereof, both ends are opened outwardly almost forming a trapezoidal-shape and tend to broaden an angle of the opening. However, since the above-described level varies, there are individual differences among arch cores 42, so that a contacting condition thereof contacting the side core 44 becomes different per arch core 42. In general, the greater the contact area of the arch core 42 contacting the side core 44, the smaller the amount of leakage of magnetic flux and the higher the heat generation effectiveness, as well as the easier the temperature increase. Conversely, if an arch core 42 having a different contact condition is mixed, temperature uniformity of the heating roller 51 in its longitudinal direction may be lost.

Then, in this embodiment of the present invention, since the side core 44 is diagonally disposed, specifically, along the line extended from the axis of the heating roller in the radius direction while the end face 44*a* of the side core 44 opposed to an outer circumferential surface of the heating roller 51 is arranged almost perpendicular to this liner line, a contact area between the arch core 42 and the side core 44 significantly varies in accordance with a variation in shape of the arch core 42. In other words, the contact area becomes smaller if the arch core and the side core make line contact therebetween. Whereas, the contact area increases when contact surfaces of the side core and the arch core become parallel to each other making surface contact therebetween in accordance with an opening condition of the arch core.

Figure 13:
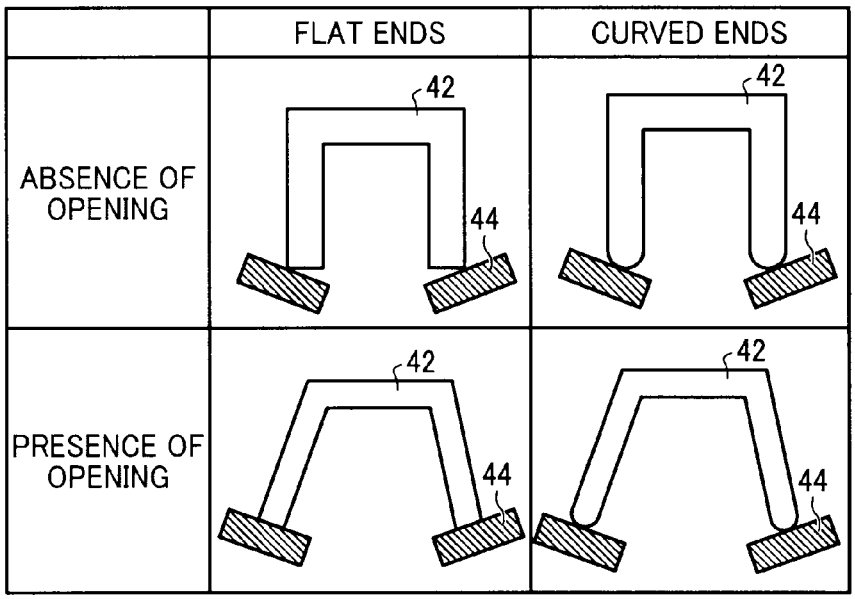
FIG. 13 is a diagram showing a modification of the arch core according to a second embodiment of the present invention.

In this respect, end faces of the both ends of the arch core 42 are curved to make surface contact with the side cores 44 in a large uniform area as much as possible as shown in the right upper and lower columns of FIG. 13 according to this embodiment of the present invention. FIG. 13 is a schematic diagram showing an aspect of the arch core 42 when placed on the side cores 44. As shown, each of the side cores is located with its leading end face being positioned parallel to an outer circumferential surface of the heating roller 51. For the sake of simplicity, a "u"-shaped arch core 42 is only shown, but the present invention is not limited thereto.

As shown in the left upper column, an arch core is formed as intended with its both ends not opened outwardly. Thus, when these both ends of the arch core are flat as conventional, the arch core 42 and the side core 44 make line contact each other. Whereas in the left lower column, an arch core is formed with its both ends being opened outwardly. Thus, when these both ends of the arch core are flat as conventional, the arch core 42 and the side core 44 make surface contact each other. Further, the arch core 42 and the side core 44 sometimes completely or partially contact each other also in the longitudinal direction (i.e., perpendicular to a sheet plane). Such a contacting condition largely changes when these ends of the arch core 42 are widely opened outwardly (as in the left lower column) than when not widely opened (as in the left upper column). Therefore, due to a variation in opening angle of the arch core between its both ends, temperature of the heat generation-layer greatly changes at portions opposite the opening (i.e., both ends).

On the other hand, according to one embodiment of the present invention, when the arch core has curved end faces at its both ends, the arch core 42 contacts the side core 44 via the curved end faces as shown in the right upper and lower columns. As a result, the contacting condition is stabilized regardless of a variation in opening angle between these ends of the arch core. Accordingly, temperature uniformity of the heating roller in the longitudinal direction is not lost by the variation in opening angle between these ends of the arch core.

In addition, an arch core can be obtained at low cost by providing curved end faces to both ends thereof. Because, when the arch core has at flat end faces at its both ends, a tolerance of the opening angle needs to be strictly managed to obtain a constant contact condition resulting in increasing cost due to degrading of yielding thereof. Hence, heat uniformity can be obtained preventing the degrading of yielding without applying the strict tolerance to the opening portion according to one embodiment of this invention due to the curved end faces at both ends.

Figure 14:
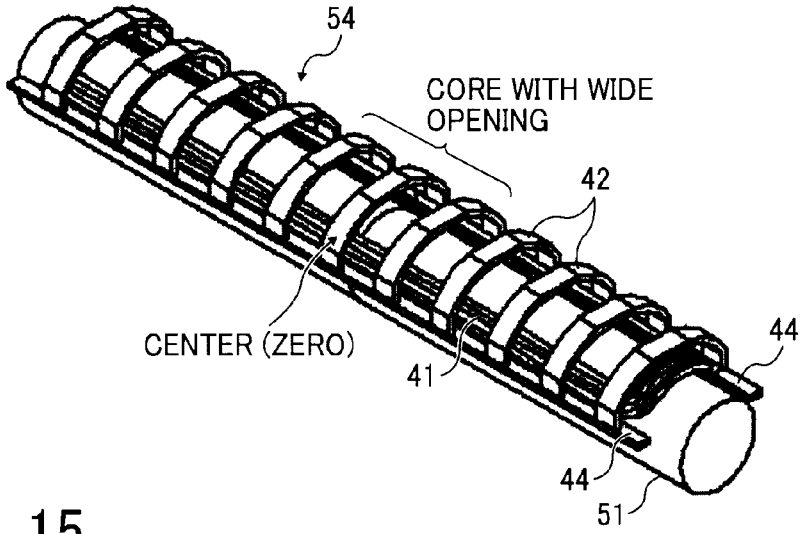
FIG. 14 is a perspective view of an induction heating coil used in heating experiment.

Now, various heat experiments executed based on first and second comparative examples and second and third embodiments are described. FIG. 14 shows the induction heating coil 54 used in various experiments with perspective view. A configuration other than the arch core with curved end faces at both ends is substantially the same as the first embodiment. As shown, arch cores 42 each having a width of about 10 mm are located longitudinally at an interval of about 20 mm. An arch core of the second embodiment is formed to have a prescribed height, a width, a thickness, and a curvature R at an end face of about 25 mm, about 60 mm, about 2.5 mm, and about 1.25 mm, respectively. A prototype core, however, has an error in the above-described width from about 60.5 mm to about 63 mm. Then, an induction heating coil 54 is assembled by selecting and disposing arch cores having a large opening angle between both ends among these prototypes within a range of ±30 mm from an origin as a center in the longitudinal direction while disposing other arch cores less than 61 mm at random in the remaining range.

Figure 15:
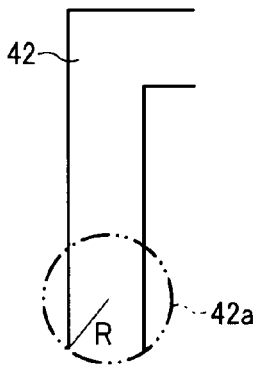
FIG. 15 is a diagram showing a curvature radius R formed on an end face of the arch core.

FIG. 15 is a schematic diagram showing a curvature radius R of an end face 42*a* of an arch core 42. An end face 42*a* of an arch core 42 at each end has a curvature radius R.

A shape of end face is the same as a side face of a cylinder having a parallel axis to a rotation axis of a heating roller 51. Thus, by forming the end face 42*a* of the arch core 42 at both ends in a curved state, the arch core 42 always contact the side core 44 via the curvature even if these ends of the arch core are opened. Accordingly, temperature of the heating roller can be substantially the same in its longitudinal direction eliminating variations in contact condition in a longitudinal direction without precisely selecting the arch cores 42 having small and large openings.

Now, a third embodiment is described. An arch core of this embodiment is prepared having a height, a width, a thickness, and a curvature R at an end face of about 25 mm, about 60 mm, about 2.5 mm, and about 5 mm, respectively, to confirm an impact when the curvature is small and the arch core and the side core contact each other almost in a plane. Then, an induction heating coil 54 is produced under substantially the same condition as the second embodiment other than the curvature.

Now, a first comparative example is described. As a first comparative example, an induction heating coil is configured to be equivalent to that of the second embodiment using an arch core having a plane end face. Specifically, to produce the induction heating coil, arch cores having a relatively large opening angle between both ends are arranged within a range of ±30 mm from the center while other arch cores having a small opening angle therebetween are arranged in the remaining range.

Now, a second comparative example is described. Contrary to the first comparative example, a prescribed cutting process is applied to end faces of both ends as finishing. Then, arch cores with its both ends contacting the side core making surface contact are arranged within a range of ±30 mm from the center, thereby preparing an induction heating coil for the second comparative example. This is to confirm an impact when an accurate arch core is mixed.

Now, evaluation result is described. Specifically, heating experiments are executed using a fixing device with induction heating coils of the second and third embodiments and the first and second comparative examples prepared in the above-described manner. More specifically, Ricoh Imagio C5000™ manufactured by Ricoh Co, Ltd., is prepared. Subsequently, an induction heating coil installed in a body of Ricoh Imagio C5000 is replaced with above-described various induction heating coils while providing a thermocouple (not shown) for measuring a surface temperature of a fixing belt in the vicinity of an inlet of a fixing nip.

Figure 16:
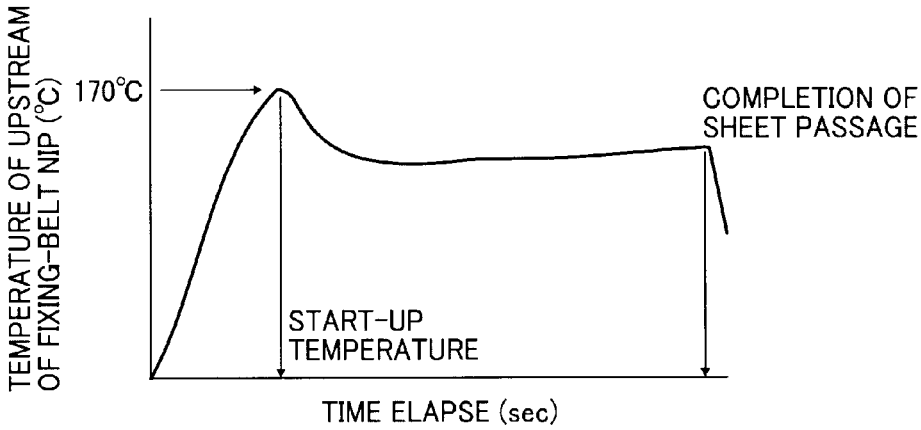
FIG. 16 is a diagram showing a typical change in temperature of an apparatus after start of an operation, observed by a thermocouple device.

FIG. 16 shows a typical change in temperature observed by the thermocouple device from a time when an apparatus starts driving. First, temperature is increased up to 170 degrees Celsius as a fixing temperature target after start driving. When 170 degree Celsius is reached, sheet feeding is started. When fifty sheets have been fed, the sheet feeding and heating and driving of a fixing belt are stopped.

Figure 17:
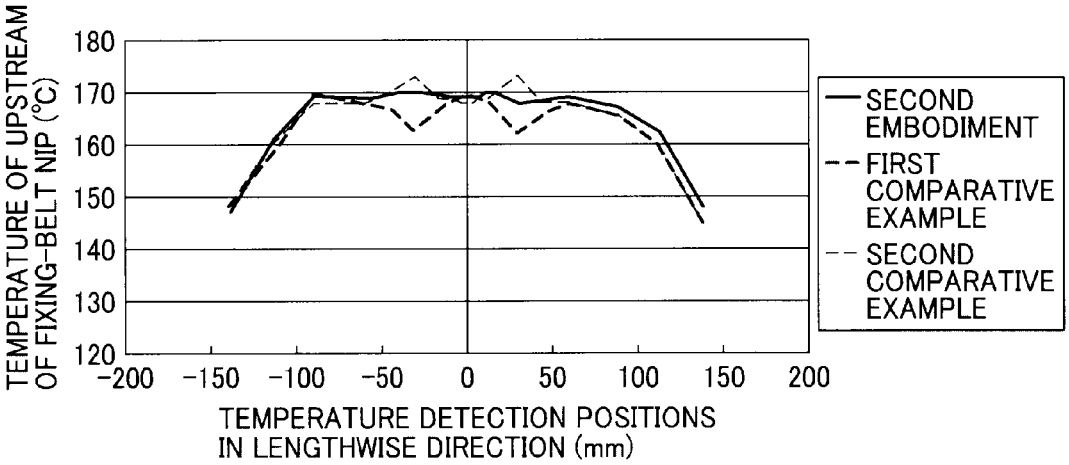
FIG. 17 shows a temperature distribution of the fixing belt in its longitudinal direction obtained in the second embodiment and first and second comparative examples immediately after 50 sheets of paper have been fed.

FIG. 17 shows distribution of temperature of the fixing belt in its longitudinal direction caused immediately after fifty sheets have been fed in the first and second comparative examples as well as in the second embodiment of the present invention. Here, a center in the longitudinal direction is regarded as an origin (i.e., 0 mm). As shown, temperature is uniform over a wide range in the longitudinal direction in the second embodiment. Whereas in the first comparative example with the arch core having flat end faces, it is confirmed that temperature decreases in a range in which the arch cores having a wide opening between their ends are arranged. By contrast, it is confirmed in the second comparative example that temperature increases in the same range.

Figure 18:
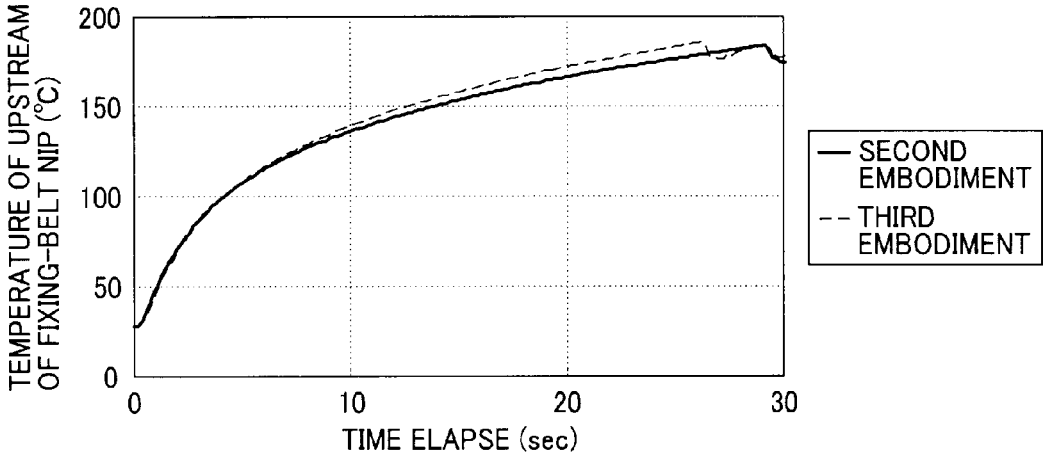
FIG. 18 is a diagram comparing impact of an R-dimension error on startup performance in the second and third embodiments.

Now, a result of comparison of an impact of a dimensional difference in curvature R of the end face between the second and third embodiments to a startup performance is described with reference to FIG. 18. It turns out that the fixing device of the third embodiment having a larger curvature R in the end faces of the arch core quickly starts up as indicated in the drawing. This is considered because the arch core and the side core contact each other almost making surface contact due to large dimension of R, and leaked flux in the contact is reduced so that heat generation effectiveness is improved.

Hence, according to this invention, it is proved that temperature uniformity in the longitudinal direction of the fixing belt is obtained without fail by disposing the side core 44 along a line extended from an axis of the heating roller 51 in a radius direction, and locating an end face 44*a* of the side core 44 opposite an outer circumferential surface of the heating roller 51 perpendicular to the line while forming the end faces of both ends of the arch core into a curved shape. Further, by increasing the dimension R of the end faces of the arch core at both ends thereof in an acceptable range, heat generation effectiveness can be further improved.

Now, a fourth embodiment is described. This embodiment is only different from other embodiments in that an induction heating coil 54 mainly consists of a casing 45, an excitation coil 41, and multiple ferromagnetic cores 42, 43, and 44 is applied to a roller type fixing device 40, and other configurations are substantially identical.

Figure 19:
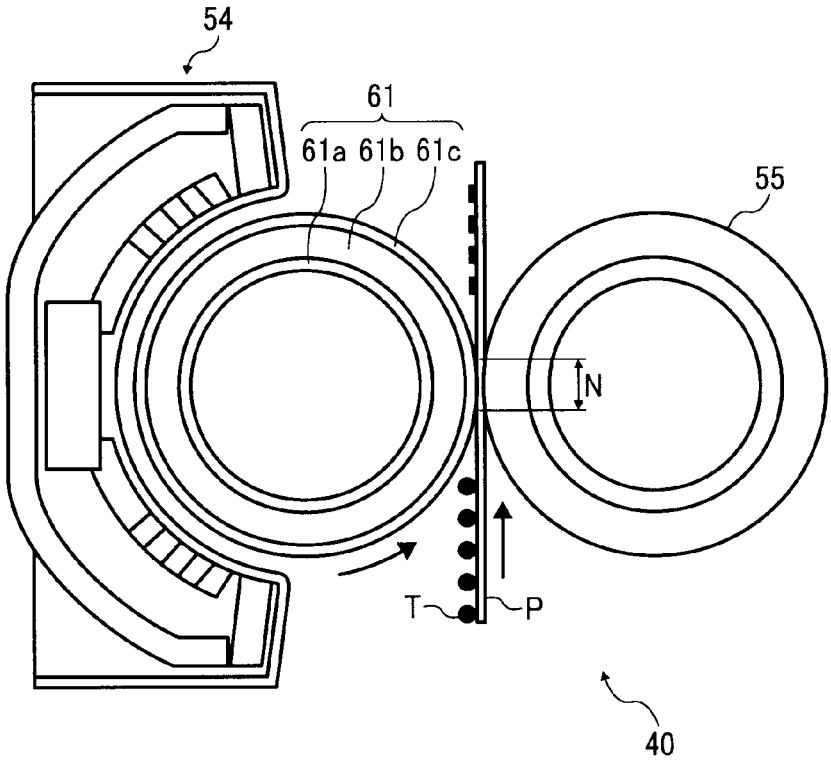
FIG. 19 is a sectional view schematically showing another configuration of a fixing device according to a fourth embodiment of the present invention.

FIG. 19 is a cross-sectional view showing another configuration of the fixing device 40. The fixing device 40 is a roller type and includes an induction heating coil 54, a fixing roller 61 serving as a heating member and a fixing member, and a pressing roller 55 that contacts and forms a fixing nip N thereon or the like. The fixing roller 61 rotates in a direction shown by arrow in the drawing generating induction heat affected by the induction heating coil 54. The fixing roller 61 then heats and fuses a toner image T on a recording medium P transported thereto.

As shown, the induction heating coil 54 is disposed opposite an outer circumferential surface of the fixing roller 61 and causes induction heating in a heat generation layer 61*c* thereby heating the fixing roller 61. Further, the side core 44 is placed along a line (a radial line) extended from an axis of the heating roller 51. The end face 44*a* of the side core 44 opposed to an outer circumferential surface of the heating roller 51 is arranged almost perpendicular to this line. Accordingly, almost all of magnetic flux diffused drawing a parabolic as parting from the core passes through the fixing roller 61. Hence, by increasing an area of the side core opposite the fixing roller 61, heat generation effectiveness can be improved.

The above-described fixing roller 61 has a multi-layer structure and is mainly composed of a metal core 61*a*, an elastic layer 61*b*, and the heat generation layer 61*c* in this order from an inside thereof as laminate. Specifically, the fixing roller 61 has a diameter of approx. from 30 mm to approx. 40 mm and is configured by stacking the elastic layer 61*b*, the heat generation layer 61*c*, and a mold releasing layer (not shown) or the like on the metal core 61*a* as laminate.

The mold releasing layer (not shown) is formed on the fixing roller 61 as an outmost layer. The mold releasing layer may be made of fluorocarbon resin, such as polytetrafluoride ethylene resin (PTFE), polytetrafluoride ethylene-perfluoroalkyl vinyl ether copolymer resin (PFA), polytetrafluoride ethylene-hexafluoride propylene copolymer (FEP), etc., or these resin mixture, or heat-resistant resin with dispersion of these fluorocarbon resins. Such a mold releasing layer has a thickness of from about 5 μmm to about 50 μmm (preferably, from about 10 μmm to about 30 μmm). Hence, prescribed mold releasing performance of toner borne on the fixing roller 61 is assured and flexibility of the fixing roller 61 is maintained at the same time.

The heat generation layer 61*c* is made of material having a low electrical resistance. As metal suitable for induction heating, a high resistance one is generally known. However, by thinning high-conductivity material, a substantial resistance of a heat generation layer 61*c* may be optionally obtained, thereby capable of improving a heat generation amount. In this fourth embodiment, a copper layer having a thickness of about 10 μm is used as the heat generation layer 61*c*. Since the heat generation layer is suitable if having a preferable conductivity, metal, such as aluminum, silver, magnesium, nickel of magnet, etc., is employed.

Further, fluorine rubber, silicone and fluorosilicone rubbers, and other material are available as an elastic layer 61*b*. By employing an elastic layer 61*b* on the fixing roller 61 and allowing the fixing roller 61 to deform thereby increasing a width of a nip region, while lowering a roller hardness of the fixing roller 61 than that of the pressing roller 55, sheet ejection and separation performance can be improved.

By including elastic sponge rubber, the elastic layer 61*b* can remain insulated from heat of the heat generation layer 61*c*. For the same reason, the elastic layer 61*b* and the mold releasing layer disposed on a front surface side of the fixing roller is quickly heated and the surface thereof quickly reaches a prescribed temperature necessary for fixing. At the same time, a recording medium can be promptly supplied with heat even when the recording medium has taken the heat. Depending on the above-described configuration, a preferable nip region is formed. Insulation from heat of the heat generation layer 61*c* is kept. In addition, heat transfer to an inside of the fixing roller can be suppressed.

Now, a fourth embodiment is described, in which a foam silicone rubber halving a thickness of about 9 mm is used as an elastic layer 61*b*. Heat is not easily flown from the heat generation layer 61*c* positioned on the front surface of the fixing roller 61 into an interior of the fixing roller, thereby capable of heating effectively.

The metal core layer 61*a* is provided to give a prescribed amount of rigidity capable of withstanding load, which is put on the fixing roller 61 to form a nip region thereon. Further, with insulation and non-magnetic material, such as ceramic, etc., the core metal layer 61*a* can employ material not providing an impact on induction heating. In the fourth embodiment, the core metal layer is made of aluminum and has an outer diameter of about 22 mm and a thickness of about 2 mm. Such a thickness provides a prescribed amount of stiffness to withstand a prescribed amount of load, which is put on the fixing roller 61 to form a nip region thereon.

Figure 20:
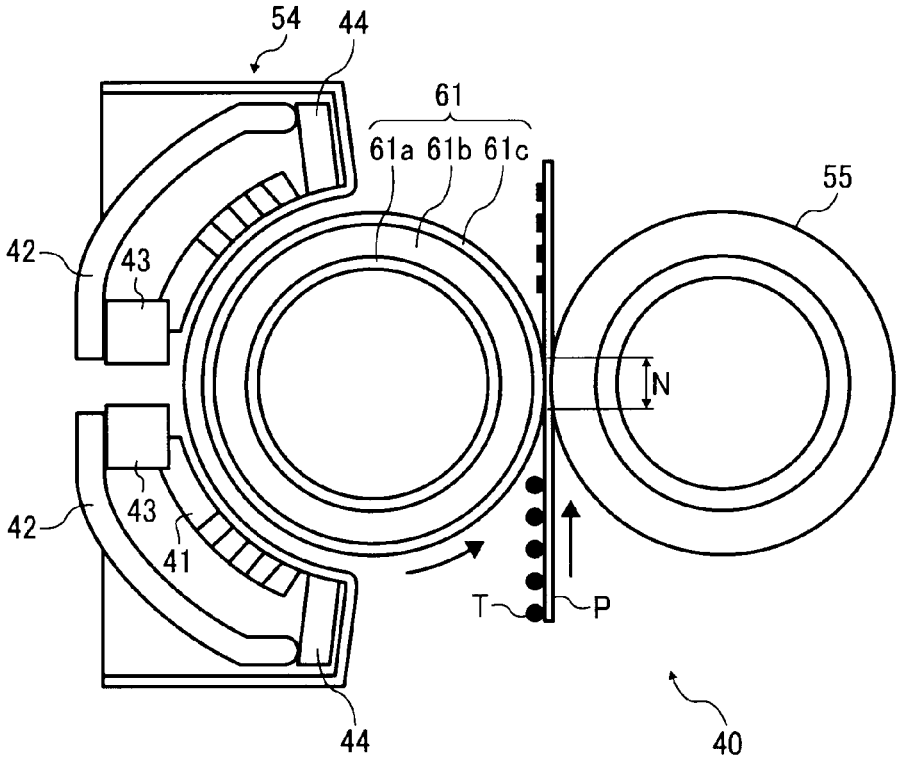
FIG. 20 is a cross-sectional view schematically showing another configuration of an induction heating coil provided in a roller type fixing device.

FIG. 20 is a schematic cross-sectional view showing another induction heating coil 54 provided in the fixing device 40 of the roller type, wherein the same parts as described with reference to FIG. 19 is not described again. An arch core 42 used in this embodiment is simply to be located behind the excitation coil 41 while being opposed to the heat generation layer 61*c* of the rotating fixing roller 61. Accordingly, a shape of the arch core 42 other than its one end is optional, if an end face of the arch core contacting the side core 44 at the one end is curved.

Accordingly, as shown in the drawing, a pair of center cores 43 and a pair of arch cores 42 respectively divided as two parts are provided in the induction heating coil 54. Further, each end face of the arch core 42 is curved and only contacts the side core 44. Whereas, the other end of the arch core 42 contacts the center core 43. By providing a curved end face to the arch core 42 contacting the side core 44, temperature uniformity in a longitudinal direction of the fixing roller 61 can be absolutely obtained.

Figure 21:
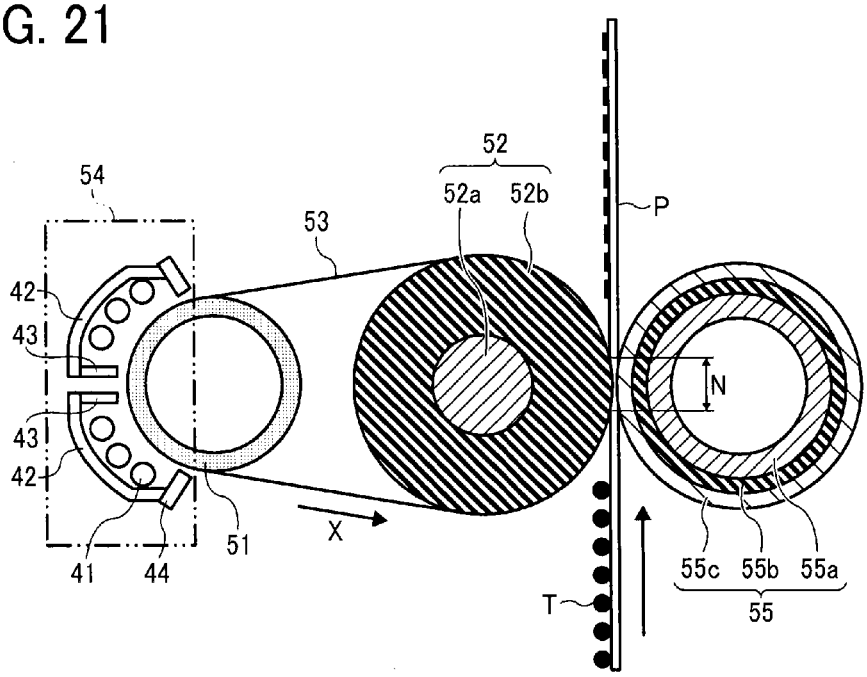
FIG. 21 is a cross-sectional view schematically showing yet another configuration of an induction heating coil provided in a belt type fixing device.
Figure 22:
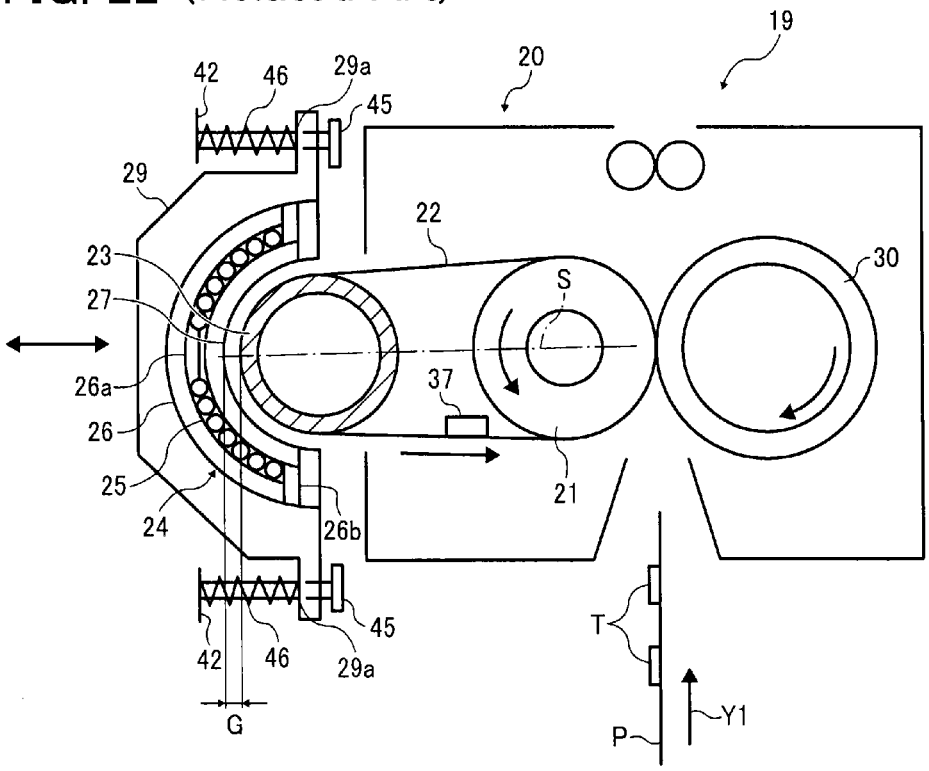
FIG. 22 (Related Art)
FIG. 22 is a cross-sectional view of a conventional fixing device disclosed in JP-2006-350054-A.

FIG. 21 is a schematic sectional view showing another configuration of a fixing device 40 of a belt type employing an induction heating coil 54, wherein the same parts as described with reference to FIG. 20 is not described again. In addition, a pair of center cores 43 and a pair of arch cores 42 respectively divided as two parts are provided in the induction heating coil 54 as shown. Further, each end face of the arch core 42 is curved and only contacts the side core 44. Whereas, the other end of the arch core 42 contacts the center core 43. By providing a curved end face to the arch core 42 contacting the side core 44, temperature uniformity in a longitudinal direction of the fixing roller 61 can be absolutely obtained even if one end of the arch core only contacts the side core 44.

According to one embodiment of the present invention, by placing an end face 44*a* of the side core 44 opposite the outer circumferential surface of the heating roller 51 almost perpendicular to the line, an area of the end face opposite the outer circumferential surface of the heating roller 51 can be increased and leakage of flux not passing through the heating roller 51 can be reduced while upgrading heat generation effectiveness. Further, by making the end face of the second core contacting the first core into a curved state, a contact area between of the first and second cores can be constant and a stable temperature distribution in the longitudinal direction of the fixing member can be obtained with a simple configuration even if the first core is disposed in this way. Further, a preferable fixing device and an image forming apparatus with the fixing device capable of quickly starting up can be obtained.

Numerous additional modifications and variations of the present invention are possible in light of the above teachings. It is therefore to be understood that within the scope of the appended claims, the present invention may be practiced otherwise than as specifically described herein.

What is claimed is:

1. A fixing device comprising:

a fixing member having a heat generation layer;

an excitation coil disposed opposite an outer circumferential surface of the fixing member to cause the fixing member to induce electromagnetic heat;

a magnetic core to form a continuous magnetic path guiding a magnetic flux generated by the excitation coil to the fixing member; and a holder to accommodate and hold the excitation coil and the magnetic core, wherein said magnetic core includes at least one first core arranged opposite the outer circumferential surface of the fixing member not via the excitation coil along a line extended from an axis of the fixing member in a radius direction, an end face of said at least one first core being opposite the outer circumferential surface of the fixing member and substantially perpendicular to the line, and wherein said magnetic core further includes a second core having a curved end face to contact the at least one first core, said magnetic core covering a substantial portion of the excitation coil.

2. The fixing device as claimed in claim 1, wherein said at least one first core has a shape of substantially a rectangular parallelepiped.

3. The fixing device as claimed in claim 1, wherein a pair of first cores not arranged parallel to each other contacts the second core in the holder.

4. The fixing device as claimed in claim 1, further comprising at least one spacer disposed between the holder and the at least one first core to position the at least one first core.

5. The fixing device as claimed in claim 4, wherein said at least one spacer is constituted by a rib integrally molded with the holder.

6. The fixing device as claimed in claim 1, wherein said fixing device is a belt-type fixing device comprising:

a heating roller as the fixing member;

an auxiliary fixing roller;

a fixing belt stretched by the heating roller and the auxiliary fixing roller; and a pressing roller pressing against the auxiliary fixing roller through the fixing belt.

7. The fixing device as claimed in claim 1, wherein said fixing device is a roller-type fixing device comprising:

a fixing roller as the fixing member; and a pressing roller pressing against the fixing roller.

8. The fixing device as claimed in claim 1, wherein the curved end face has a substantially cylindrical profile.

9. The fixing device as claimed in claim 1, wherein the curved end face has a radius of curvature of more than half of a thickness of the second core.

10. An image forming apparatus to form an image, comprising:

an image formation device to form a toner image; and a fixing system to fix the toner image, said fixing system including:

a fixing member having a heat generation layer;

an excitation coil disposed opposite an outer circumferential surface of the fixing member to cause the fixing member to induce electromagnetic heat;

a magnetic core to form a continuous magnetic path guiding a magnetic flux generated by the excitation coil to the fixing member;

a holder to accommodate and hold the excitation coil and the magnetic core;

at least one first core included in the magnetic core, wherein said at least one first core is arranged opposite the outer circumferential surface of the fixing member not via the excitation coil along a line extended from an axis of the fixing member in a radius direction, an end face of said at least one first core arranged opposite the outer circumferential surface of the fixing member and substantially perpendicular to the line; and a second core included in the magnetic core, wherein said second core has a curved end face to contact the at least one first core, said magnetic core covering a substantial portion of the excitation coil.

11. A fixing device comprising:

means for generating electromagnetic heat and fixing a toner image with the heat;

means for inducing the electromagnetic heat generating means to generate electromagnetic heat, said inducing means including an excitation coil disposed opposite an outer circumferential surface of the electromagnetic heat generating means;

means for forming a continuous magnetic path for guiding a magnetic flux generated by the inducing means to the electromagnetic heat generating means;

means for holding the inducing means and the continuous magnetic path forming means;

at least one first core included in the continuous magnetic path forming means, said at least one first core being arranged opposite the outer circumferential surface of the electromagnetic heat generation means not via the inducing means along a line extended from an axis of the electromagnetic heat generation means in a radius direction, an end face of said at least one first core being arranged opposite the outer circumferential surface of the electromagnetic heat generating means and substantially perpendicular to the line; and a second core included in the continuous magnetic path forming means, said second core having a curved end face to contact the at least one first core, wherein said continuous magnetic path forming means cover a substantial portion of the above-mentioned inducing means.

12. The fixing device as claimed in claim 11, wherein said at least one first core has a shape of substantially a rectangular parallelepiped.

13. The fixing device as claimed in claim 11, wherein a pair of first cores not arranged parallel to each other contacts the second core in the holding means.

14. The fixing device as claimed in claim 11, further comprising means for positioning the at least one first core, said positioning means being disposed between the holding means and the at least one first core.

15. The fixing device as claimed in claim 14, wherein said at least one positioning means is constituted by a rib integrally molded with the holding means.

16. The fixing device as claimed in claim 11, wherein said heat generating means include a belt-type fixing device comprising:

a heat generator;

a heating roller heated by the heat generator;

an auxiliary fixing roller;

a fixing belt stretched by the heating roller and the auxiliary fixing roller; and means for applying pressure onto the auxiliary fixing roller through the fixing belt.

17. The fixing device as claimed in claim 11, wherein said fixing means include a roller-type fixing device comprising:

a fixing roller; and means for applying pressure onto the fixing roller.

18. The fixing device as claimed in claim 11, wherein the curved end face has a substantially cylindrical profile.

19. The fixing device as claimed in claim 11, wherein the curved end face has a radius of curvature of more than half of a thickness of the second core.

* * * * *